United States Patent [19]

Du Bruyn

[11] Patent Number: 5,050,318

[45] Date of Patent: Sep. 24, 1991

[54] DRIER RACKING SYSTEM

[75] Inventor: Petrus F. Du Bruyn, Brits, South Africa

[73] Assignee: Vetsak Koöperatief Beperk, Transvaal, South Africa

[21] Appl. No.: 500,770

[22] Filed: Mar. 28, 1990

[30] Foreign Application Priority Data

Mar. 31, 1989 [ZA] South Africa ..... 89/2386

[51] Int. Cl.[5] ..... F26B 19/00

[52] U.S. Cl. ..... 34/217; 34/204; 198/803.13

[58] Field of Search ..... 34/204, 216, 217; 198/819, 803.13, 484.1; 414/157

[56] References Cited

U.S. PATENT DOCUMENTS

| | | | |
|---|---|---|---|
| 1,319,077 | 10/1919 | Hickcox | 198/803.13 |
| 1,339,092 | 5/1920 | Benjamin | 34/204 |
| 1,864,415 | 6/1932 | Clark | 198/803.13 |
| 4,194,300 | 3/1980 | Swanson et al. | 34/217 |
| 4,768,642 | 9/1988 | Hunter | 198/484.1 |

*Primary Examiner*—Edward G. Favors
*Attorney, Agent, or Firm*—McGlew & Tuttle

[57] ABSTRACT

A drier racking system for use in drying produce in a barn which includes an endless conveyor to which are attached a plurality of containment devices. The conveyor extends from a door of the barn to an inner region of the barn. The containment devices open, or are openaable, when positioned near the door and produce can be loaded, into or be removed from, the devices.

9 Claims, 3 Drawing Sheets

DRIER RACKING SYSTEM

BACKGROUND OF THE INVENTION

This invention relates generally to the drying of produce and is concerned more particularly with a drier racking system. The invention will be described hereinafter with particular reference to the drying of tobacco leaves but it is to be understood that the principles described hereinafter may be used with equal effectiveness for the drying of other produce.

When tobacco leaves are harvested they are brought to a processing point where the leaves are packed into frames which permit air passage through the leaves. The leaves are compressed in the frames and the individual frames are thereafter loaded on to racks in a drying barn. This process is time consuming and laborious.

SUMMARY OF THE INVENTION

The invention is concerned with a drier racking system which facilitates the handling of produce which is to be dried.

The invention provides a drier racking system for use in a drying barn which includes at least one conveyor which is mounted inside the barn and which extends from a doorway of the barn to an inner region of the barn, and a plurality of containment devices which are attached to the conveyor and which in use contain produce which is to be dried in the barn, the conveyor being so positioned that the containment devices are brought in succession to the doorway upon movement of the conveyor.

In one form of the invention the conveyor includes at least a first guide which is rotatably mounted adjacent the doorway of the barn, at least a second guide which is rotatably mounted at the said inner region of the barn, and at least one endless flexible member which passes over the first and second guides, the said plurality of containment devices being fixed to the endless member, adjacent one another, over at least approximately half of the length of the endless member.

Preferably at least the first guide and the containment devices are so dimensioned that adjacent containment devices, when circumferentially positioned on the first guide, are in divergent positions relatively to one another.

In one embodiment of the invention each containment device is in the form of a container which includes a frame with relatively movable portions which are movable to first positions at which produce may be loaded into or removed from the container, and second positions at which the produce is kept captive within, or supported by, the container.

In a different embodiment each containment device comprises at least two adjacent components which are fixed to the endless flexible member, the components being in divergent positions when on the first guide whereby produce can be placed between the components, and the components being caused to converge, when the components are moved away from the first guide, thereby to engage with and support the produce.

The conveyor may take on any suitable shape or form. The conveyor may be mounted for movement along any suitable path within the barn.

The endless flexible member of the conveyor may comprise a cable, a chain, or any similar device or combination of such devices.

According to one aspect of the invention use is made of a chain to which the containment devices are attached, and the first and second guides comprise sprockets or the like which receive the chain in suitable formations.

The guides may be rotatable and may be mounted for movement about axes which are horizontal, or vertical, according to requirement.

The racking system may include support means extending alongside the conveyor which are positioned to support at least some of the containment devices between the first and second guides.

To load produce into the containment devices use may be made of a produce handling mechanism which is positioned adjacent the first guide and which is movable between a first position at which produce can be engaged with the mechanism, and a second position at which the produce which is engaged with the mechanism is brought between the said two components of a respective containment device.

The aforementioned inventive principles may be used in the construction of a produce drier or in the refurbishing or reconstruction of an existing drier. In this respect each conveyor is then mounted so that the endless member which is used for moving the containment devices is so positioned that the containment devices are caused to move on, or off, already existing guides or supports which are used for supporting conventional containers of the kind used in existing drying systems.

As has been indicated use may be made of a plurality of conveyors within a single barn. The conveyors may be positioned alongside one another, or above each other, in order to make maximum use of the available space inside a given drying barn.

The invention also extends to a method of loading produce into a drying barn which includes the steps of simultaneously loading a first containment device which has been packed with produce, into the drying barn, and advancing a second containment device to a loading position at which it is ready to be packed with produce.

When the second containment device is moved to the loading position it is oriented so that it may be opened to provide access for packing produce into the containment device.

When the second containment device is loaded into the barn, a third containment device is moved to the loading position, and, in accordance with one possible feature of the invention, the first and second containment devices are thereby brought substantially alongside one another.

In a variation of the invention produce is loaded onto a platform, optionally compressed, and the platform with the produce is moved between two components of a containment device which are then moved to an operative position at which the produce is supported by the containment device and which the platform may be withdrawn from between the components.

This facilitates loading of the produce into the barn for drying.

BRIEF DESCRIPTION OF THE DRAWINGS

The invention is further described by way of example with reference to the accompanying drawings in which.

DESCRIPTION OF PREFERRED EMBODIMENT

Figure 2:
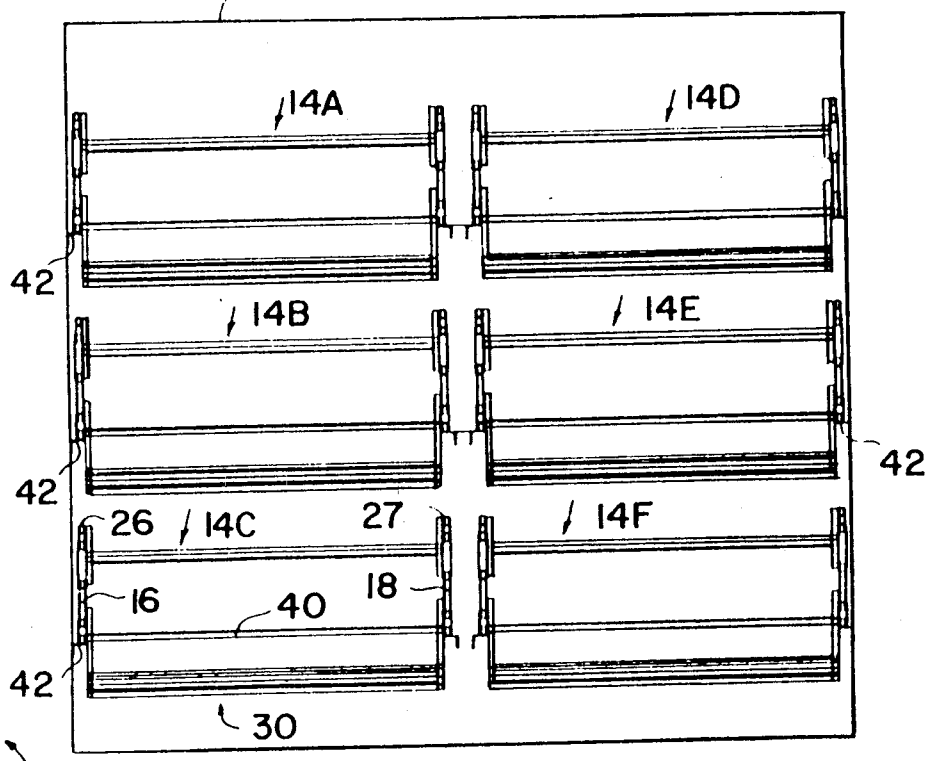
FIG. 2 is a schematic end view of the drying system of FIG. 1.

The accompanying drawings FIGS. 1 to 5 illustrate a produce drying system 10 according to the invention which, in this case, is used for the drying of tobacco leaves.

The produce drying system includes a barn 12 in which are mounted six conveyors designated respectively 14A to 14F. In this instance the conveyors 14A to 14C are positioned one above the other and alongside the conveyors 14D to 14F which are also positioned one above the other.

Each conveyor 14 includes a first pair of sprockets 16 and 18 respectively, mounted for rotation about a common axis 20, a second pair of sprockets, only one of which is visible in the drawing, marked 22, which are mounted for rotation about a common axis 24, endless members 26 and 27 respectively which pass around the sprocket 16 and the sprocket 22, on the one hand, and the sprocket 18 and the sprocket which opposes the sprocket 22, on the other hand, and a plurality of containers 30 which are fixed to the endless members.

Each endless member is made up of two components namely a cable 26A and a chain 26B which is of the kind used in chain conveyors.

The combination of a cable with a chain reduces the expense of fabricating the endless member.

Figure 3:
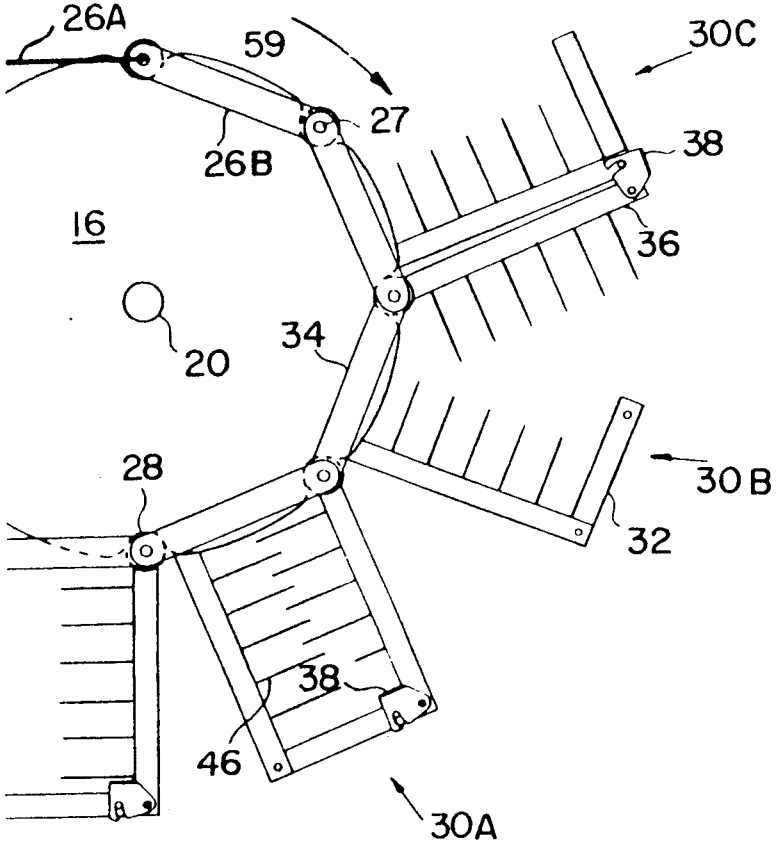
FIG. 3 is an enlarged side view of portion of the drying system of FIG. 1.

As is more clearly seen from FIG. 3, rollers 44 of the chain 26B are engagable with recessed formations 28 formed in the outer surface of each respective sprocket. The sprockets also include grooves which receive the cable portions 26A when these are moved to the sprockets.

The containers 30 are mounted to the chain, and not to the cable. Each container includes a L-shaped portion, see FIG. 3, designated 32 which is fixed, relatively movably, to opposed respective links 34 of the two chains 26B which are engaged with the two pairs of sprockets, and a relatively pivotal section 36 which is pivotally attached, for example, to an axle of an adjacent roller 44 and which can be coupled to the portion 32 by means of a catch 38. When the two portions are uncoupled from one another the catch 38 may be used to secure the portion 36 of one container, designated for ease of reference 30B, to an adjacent container which has been designated 30C.

Figure 4:
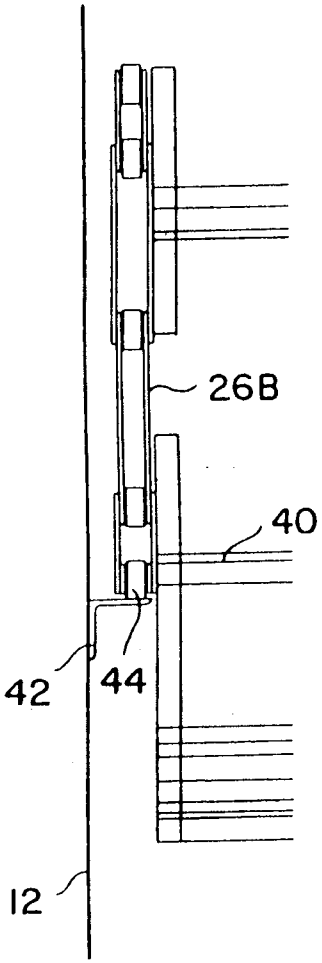
FIG. 4 is a enlarged end view of portion of the conveyor, as shown in FIG. 3.

As may be seen from FIGS. 2 and 4 each container 30, viewed end on, extends substantially across half the width of the barn 12. Frame members 40 extend across the width of each container and rigidify it.

The barn 12 may be of a conventional construction and include guides 42, which form horizontally extending platforms, along its length. The guides 42 are fixed to an inner wall of the barn or any other suitable support structure. The sprockets and the guides are so positioned relatively to one another that the chains 26B, when moving along a lower path of the conveyor, are located with the rollers 44 bearing on upper surfaces of the respective guides 42. This ensures that the weight of the conveyor, together with the weight of the attached containers, is carried mainly by the guides and not by the sprockets.

Figure 5:
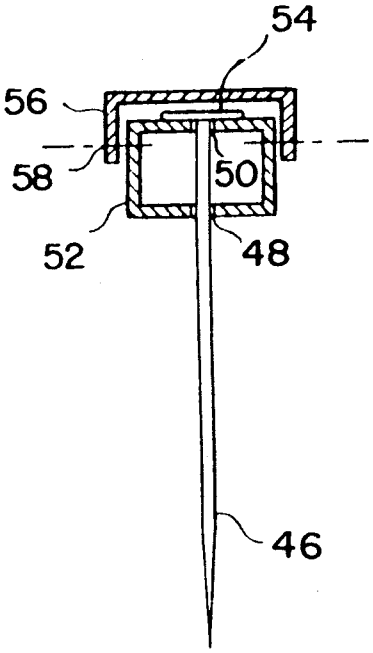
FIG. 5 depicts the manner in which spikes are fixed to containers used in the drying system of the invention.

Each container includes a plurality of spikes 46 attached to opposing inner surfaces of the frame components 32 and 36 respectively. FIG. 5 illustrates a spike 46, which may for example comprise a wire nail or the like, which is threaded through holes 48 and 50 in a box section 52 of a frame so that a head 54 of the nail is brought into contact with an outer surface of the box section, and which is kept in position by means of a channel member 56 which engages over the box section. Suitable fastening devices 58, e.g. screws or the like, are used to retain the members 52 and 56 to one another. Each frame member 40 may consist of a pair of the members 52 and 56.

In use of the drying system produce is loaded into each of the conveyors in turn. Each conveyor is advanced, in a desired direction, by any suitable means. Use may be made of electric motor drives or the like, dependent on the degree of force that is required, but in many instances the conveyors will be such that they can be advanced manually.

The sprocket pairs 16 and 18 are positioned adjacent a doorway 57 of the barn. The corresponding sprocket pairs 22, on the other hand, are positioned at opposing inner regions of the barn.

When the endless members 26 are advanced the containers 30, fixed to the chains 26B, are successively moved over the sprockets 16 and 18 and, due to the curvature of the sprockets, the containers are caused to diverge from one another, as is shown in FIG. 3. In this Figure three of the containers are designated 30A, 30B and 30C, respectively, for ease of identification.

The lowermost of the three containers referred to is packed with produce such as tobacco leaves which are impaled on the spikes 46. Assume in this instance that the sprocket is caused to move in a clockwise direction as is indicated by means of an arrow 59. The following container, designated 30B, is oriented so that its movable frame section 36 can be swung away from the fixed section 32 and, by means of the catch 38, can be coupled to the third or uppermost container 30C.

With the container 30B in the orientation shown in FIG. 3 produce can be loaded into the container or can be removed from the container. Assume that produce is loaded into the container then, once the container is full, the movable section 36 is swung downwardly and the two sections are re-engaged with one another by means of the catch 38.

The conveyor is then further advanced in the clockwise direction and the container 30B is moved downwardly while the container 30C takes up the position previously occupied by the container 30B.

The process continues in the aforementioned manner with successive containers being packed and then being moved to positions at which they abut one another and are moved fully into the drying barn, being supported on the guides 42. Clearly when the containers are to be emptied the reverse procedure is followed.

The invention makes use of containers which are held, substantially permanently, captive to the endless members 26. The containers are relatively light and normally have a reduced capacity compared to conventional containers encountered in tobacco drying systems. Thus the mass which is supported by each container which is not engaged with the guides 42, e.g. when the container is in any of the positions shown in FIG. 3, is not substantial. The containers, having a low capacity, are relatively easy and inexpensive to fabricate and, through the use of low cost wire nails as spikes, further cost savings are effected.

In contrast with conventional methods of drying tobacco leaves, in using the system of the invention, leaves which are to dried are loaded directly into the captive containers and then into the barn. With the conventional approach heavy containers are loaded outside of the barn and each container, filled with leaves, is then manhandled into position in the barn 90. It has been found, through the use of the system of the invention, that a substantial reduction in labour requirements is achieved.

Figure 1:
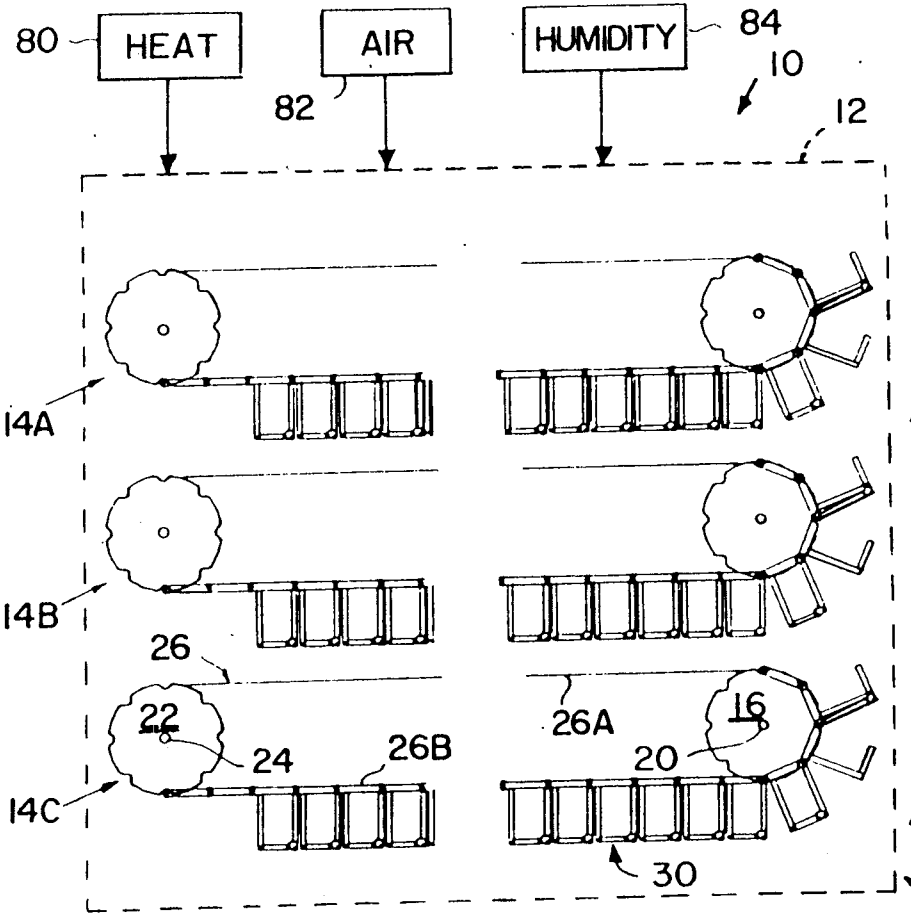
FIG. 1 is a schematic side view of a produce drying system according to one form of the invention.

Referring to FIG. 1 it is apparent that if the conveyers are closely stacked to one another it is necessary to move each conveyor so that the empty containers are inverted, i.e. above the conveyors, and then to pack produce into the containers starting with the lowermost conveyor, the one above that, and so on.

The invention has been described with reference to the drying of tobacco leaves but clearly the principles of the invention can be employed for the drying of any other produce.

Figure 6:
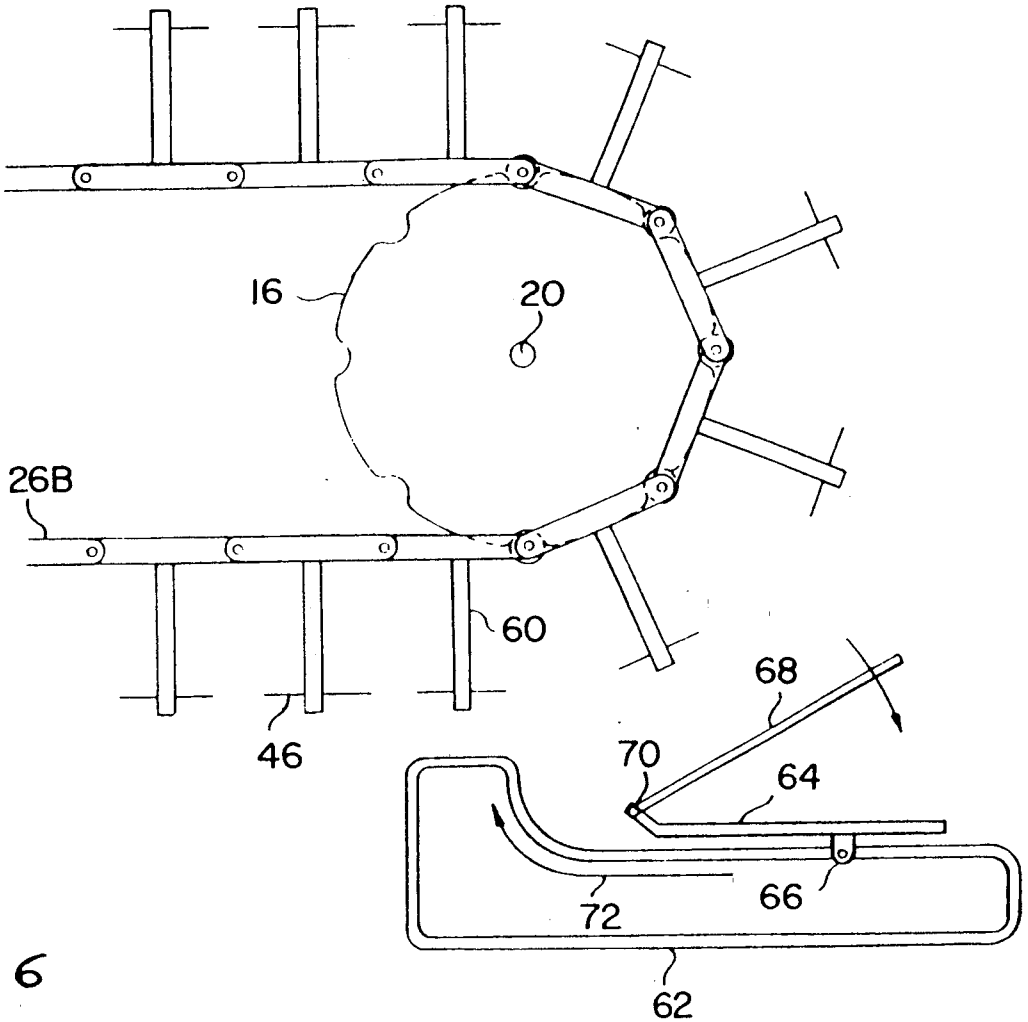
FIG. 6 illustrates a variation of the invention.

FIG. 6 illustrates a variation of the invention which facilitates the loading of produce into a drier.

A chain 26B passes over a sprocket 16. Each link of the chain has a frame component 60 attached to it with spikes 46 extending in opposing directions. A guide track 62 positioned below the sprocket 16 has a platform 64 engaged with it by means of one or more rollers 66 which ride in the guide.

A lever 68 is pivotally attached to the platform 64 at a point 70.

A predetermined quantity of produce, such as tobacco leaves, is loaded onto the platform 64 and the lever 68 is then brought downwardly to compress the produce on the platform.

The platform is then moved along the guide, as indicated by an arrow 72, so that the platform moves from a horizontal orientation to a vertical orientation at which the platform is positioned between two spread apart components 60 adjacent the sprocket 16.

When the chain conveyor is advanced the components 60 are moved together and the spikes 46 on the components impale the produce. The FIG. 6 arrangement considerably facilitates loading of the produce into the drier on the platform.

The platform is then moved further along the guide, and so moves downwardly, withdrawing from between the components. The platform is restored to the original position and so is available for the loading of the next section of the conveyor.

It is to be understood that in the use of the system of the invention the barn 10 includes heat, ventilation and humidity control devices of any appropriate kind, designated 80, 82 and 84 respectively in FIG. 1 to control the environment inside the barn in accordance with desired criteria.

Devices of this type are known in the art and thus are not described herein. A knowledge of their construction and manner of working is unnecessary for an understanding of the present invention.

I claim:

1. A drier racking system for use in a produce drying barn which includes at least one conveyor which is mounted inside the barn and which extends from a doorway of the barn to an inner region of the barn, and a plurality of containment devices, the conveyor including at least a first guide which is rotatably mounted adjacent the doorway of the barn, at least a second guide which is rotatably mounted at the said inner region of the barn, and at least one endless flexible member which passes over the first and second guides, the said plurality of containment devices being fixed to the endless member, adjacent one another, over at least approximately half of the length of the endless member, the conveyor being movable in a first direction whereby containment devices are moved in succession past the doorway, for loading with produce, to respective drying positions inside the barn below the conveyor and, in a second direction which is opposite to the first direction, whereby containment devices are moved in succession past the door, so that produce can be unloaded from the containment devices, to respective positions inside the barn above the conveyor.

2. A drier racking system according to claim 1 wherein at least the first guide and the containment devices are so dimensioned that adjacent containment devices, when circumferentially positioned on the first guide, are in divergent positions relatively to one another.

3. A drier racking system according to claim 1 wherein each containment device is in the form of a container which includes a frame with relatively movable portions which are movable to first positions at which produce may be loaded into or removed from the container, and second positions at which the produce is kept captive within, or is supported by, the container.

4. A drier racking system according to claim 2 wherein each containment device comprises at least two adjacent components which are fixed to the endless flexible member, the components being in divergent positions when on the first guide whereby produce can be placed between the components, and the components being caused to converge, when the components are moved away from the first guide, thereby to engage with and support the produce.

5. A drier racking system according to claim 4 which includes a produce handling mechanism which is positioned adjacent the first guide and which is movable between a first position at which produce can be engaged with the mechanism, and a second position at which the produce which is engaged with the mechanism is brought between the said two components of a respective containment device.

6. A drier racking system according to claim 1 which includes support means extending alongside the conveyor which are positioned to support at least some of the containment devices between the first and second guides.

7. A dryer racking system for use in a produce drying barn which includes a plurality of conveyors which are mounted in adjacent relation inside the barn, aligned one above the other and which extend from a doorway of the barn to an inner region of the barn, and a plurality of containment devices for each conveyor, each conveyor including at least a first guide which is rotatably mounted adjacent the doorway of the barn, at least a second guide which is rotatably mounted at the said inner region of the barn, and at least one endless flexible member which loops over the first and second guides providing upper and lower containment device feed paths extending in opposite horizontal directions, means fixing the containment to the respective endless members such that the containment devices are adjacent one another and extend along approximately half of the length of the respective endless member to which they are fixed, the lower feed path of the upper conveyor being coextensive with the upper feed part of the lower conveyor so that containment devices on the lower feed path of the upper conveyor can only occupy portions of such feed path vacated by containment devices of the lower conveyor and vice versa, each conveyor being moveable in a first direction whereby empty containment devices on the upper feed path are moved in succession past the doorway, for loading with produce and turned through 180° about a horizontal axis from the upper feed path to the lower feed path to respective drying positions inside the barn below the conveyor and, in a second direction which is opposite to the first direction, whereby laden containment devices are moved in succession from the lower feed path past the door, so that produce can be unloaded from the containment devices and returned through 180° about a horizontal axis from the lower feed path to respective positions inside the barn on the upper feed path above the conveyor.

8. A method of loading produce into a drying barn which includes the steps of moving a first containment device to a loading position, loading produce on to a platform, moving the platform with the produce to a location between two components of the first containment device at the loading position, moving the first containment device to an operative position at which the produce is supported by the first containment device and at which the platform can be withdrawn from between the two components, moving the first containment device, packed with produce, from the loading position into the drying barn, and simultaneously moving a second containment device to the loading position.

9. A method according to claim 8 wherein when the second containment device is loaded into the barn, a third containment device is moved to the loading position and, the first and second containment devices are thereby brought substantially alongside one another.

* * * * *